US009472855B2

(12) United States Patent
Toyao et al.

(10) Patent No.: US 9,472,855 B2
(45) Date of Patent: Oct. 18, 2016

(54) ANTENNA DEVICE

(75) Inventors: Hiroshi Toyao, Tokyo (JP); Toru Taura, Tokyo (JP)

(73) Assignee: NEC CORPORATION, Tokyo (JP)

( * ) Notice: Subject to any disclaimer, the term of this patent is extended or adjusted under 35 U.S.C. 154(b) by 107 days.

(21) Appl. No.: 14/379,543

(22) PCT Filed: Feb. 23, 2012

(86) PCT No.: PCT/JP2012/001243

§ 371 (c)(1),
(2), (4) Date: Aug. 19, 2014

(87) PCT Pub. No.: WO2013/124897

PCT Pub. Date: Aug. 29, 2013

(65) Prior Publication Data

US 2015/0029068 A1 Jan. 29, 2015

(51) Int. Cl.

| | |
|---|---|
| ***H01Q 13/10*** | (2006.01) |
| ***H01Q 1/22*** | (2006.01) |
| ***H01Q 1/24*** | (2006.01) |
| ***H01Q 1/38*** | (2006.01) |
| ***H01Q 21/28*** | (2006.01) |
| ***H01Q 5/385*** | (2015.01) |

(52) U.S. Cl.

CPC ..... *H01Q 13/106* (2013.01); *H01Q 1/2266* (2013.01); *H01Q 1/243* (2013.01); *H01Q 1/38* (2013.01); *H01Q 5/385* (2015.01); *H01Q 21/28* (2013.01)

(58) Field of Classification Search

CPC ..... H01Q 13/106; H01Q 1/38; H01Q 13/10

USPC ..... 343/700 MS, 702, 767, 770

See application file for complete search history.

(56) References Cited

U.S. PATENT DOCUMENTS

| | | | | |
|---|---|---|---|---|
| 5,068,670 | A * | 11/1991 | Maoz | H01Q 21/064 343/767 |
| 6,480,162 | B2 * | 11/2002 | Sabet | H01Q 1/36 343/767 |
| 7,403,169 | B2 * | 7/2008 | Svensson | H01Q 13/085 343/767 |
| 9,130,278 | B2 * | 9/2015 | Palevsky | H01Q 9/0435 |

FOREIGN PATENT DOCUMENTS

| | | | |
|---|---|---|---|
| JP | 5-110332 | A | 4/1993 |
| JP | 5-152831 | A | 6/1993 |
| JP | 7-221538 | A | 8/1995 |
| JP | 7-283649 | A | 10/1995 |
| JP | 11-8509 | A | 1/1999 |

(Continued)

OTHER PUBLICATIONS

Japanese Office Action for JP Application No. 2011-132508 mailed on Oct. 21, 2014 with English Translation.

(Continued)

*Primary Examiner* — Tho G Phan

(57) ABSTRACT

An antenna device 10 includes at least one dielectric substrate 2, a conductor plate 3 arranged in the dielectric substrate 2, at least one slot 4 formed in the conductor plate 3, at least one stub 5, and at least one via 6. The stub 5 is formed on a surface of the dielectric substrate 2 different from a surface where the slot is formed, the stub 5 being formed to cross the slot 4. The via 6 has one end connected to a periphery of the slot 4 of the conductor plate 3 and another end connected to the stub 5.

10 Claims, 16 Drawing Sheets

(56) References Cited

FOREIGN PATENT DOCUMENTS

| | | | |
|---|---|---|---|
| JP | 2003-87050 | A | 3/2003 |
| JP | 2003-234615 | A | 8/2003 |
| JP | 2004-48109 | A | 2/2004 |
| JP | 2004-56421 | A | 2/2004 |
| JP | 2004-215132 | A | 7/2004 |
| JP | 2004-336328 | A | 11/2004 |
| JP | 2009-55575 | A | 3/2009 |
| JP | 2010-62976 | A | 3/2010 |

OTHER PUBLICATIONS

International Search Report for PCT Application No. PCT/JP2012/001243, mailed on May 22, 2012.

* cited by examiner

ANTENNA DEVICE

This application is a National Stage Entry of PCT/JP2012/001243 filed on Feb. 23, 2012, the contents of all of which are incorporated herein by reference, in their entirety.

TECHNICAL FIELD

The present invention relates to an antenna device which is capable of adjusting a resonance frequency with high accuracy.

BACKGROUND ART

A slot antenna arranged on a dielectric substrate typically needs to have a length of a quarter wavelength of a frequency to be used. When the frequency to be used is about 800 MHz, for example, the length of the slot antenna is about 90 mm, which makes it difficult to apply such a slot antenna to mobile radio terminals where there is a large restriction in mounting space.

One method to reduce the size of an antenna device includes a method of forming a capacitor in a slot end. An antenna device is known, for example, including a substantially L-shaped slot arranged on a dielectric substrate and a capacitor formed in a slot end (see Patent literature 1).

CITATION LIST

Patent Literature

Patent literature 1: Japanese Unexamined Patent Application Publication No. 07-221538

SUMMARY OF INVENTION

Technical Problem

In the antenna device having the capacitor formed in the slot end described above, it is possible to greatly shift the resonance frequency of the antenna device with small capacitance. Meanwhile, the resonance frequency of the antenna device may drastically change depending on a slight error of capacitance to be loaded. A problem occurs, for example, that the resonance frequency of the antenna device is shifted depending on the variation of the thickness of the dielectric substrate at the time of production or the variation of relative permittivity.

The present invention has been made in order to solve the problems, and aims to provide an antenna device which is capable of adjusting a resonance frequency with high accuracy.

Solution to Problem

One exemplary aspect of the present invention to achieve the aforementioned object is an antenna device including: at least one dielectric substrate; a conductor plate arranged in the dielectric substrate; at least one slot formed in the conductor plate; at least one stub formed on a surface of the dielectric substrate different from a surface where the slot is formed, the stub being formed to cross the slot; and at least one via having one end connected to a periphery of the slot of the conductor plate and another end connected to the stub.

Advantageous Effects of Invention

According to the present invention, it is possible to provide an antenna device which is capable of adjusting a resonance frequency with high accuracy.

DESCRIPTION OF EMBODIMENTS

First Exemplary Embodiment

Figure 1:
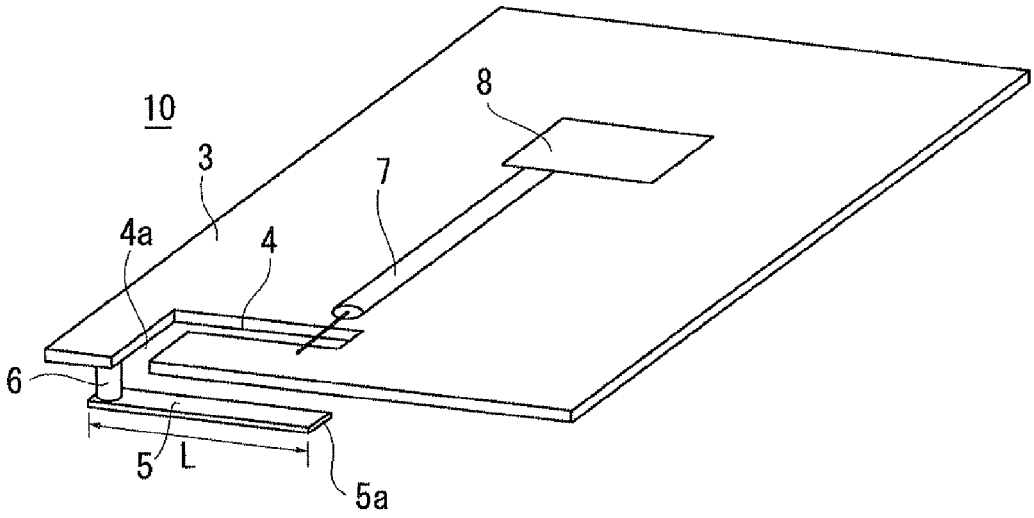
FIG. 1 is a perspective view showing a stub arranged in a slot open end of a conductor plate of an antenna device according to a first exemplary embodiment of the present invention.
Figure 2:
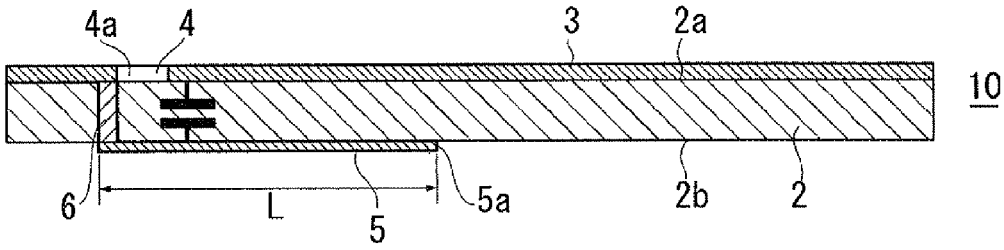
FIG. 2 is a cross-sectional view showing a schematic configuration of the antenna device according to the first exemplary embodiment of the present invention.

Hereinafter, with reference to the drawings, exemplary embodiments of the present invention will be described. FIG. 1 is a perspective view showing a stub arranged in a slot open end of a conductor plate of an antenna device according to a first exemplary embodiment of the present invention. FIG. 2 is a cross-sectional view showing a schematic configuration of the antenna device according to the first exemplary embodiment of the present invention.

An antenna device 10 according to the first exemplary embodiment includes a plate-like dielectric substrate 2 made of a dielectric material, a conductor plate 3 arranged on the side of one surface 2*a* (e.g., upper surface side) of the dielectric substrate 2, a slot 4 formed substantially in an L shape in the conductor plate 3 and having one end forming an open end 4*a* at an end surface of the conductor plate 3, a stub 5 formed on the side of the other surface 2*b* (e.g., lower surface side) of the dielectric substrate 2 so as to cross the open end 4*a*, and a via 6 having one end connected to a periphery of the open end 4*a* of the slot 4 of the conductor plate 3 and the other end connected to the stub 5.

An external conductor (first conductor) and an internal conductor (second conductor) of a coaxial cable (feed cable) 7 are connected to the conductor plate 3 on both sides of the slot 4 so as to cross the slot 4. Further, the coaxial cable 7 is connected to a radio circuit 8, and the radio circuit 8 feeds the slot 4 through the coaxial cable 7.

The stub 5 is an elongated plate-like material, and the length of the stub 5 (stub length) L is set to satisfy $L<\lambda/4$, where $\lambda$ represents a wavelength corresponding to a frequency to be used. Further, the width of the stub 5 (stub width) is sufficiently small compared to the stub length L. The stub 5 has one end connected to a periphery of the open end 4*a* of the slot 4 of the conductor plate 3 through the via 6, and the other end which is an open end 5*a*.

In the antenna device 10 formed as described above, the stub length L of the stub 5 arranged in the open end 4*a* of the slot 4 is set so as to satisfy $L<\lambda/4$. In this case, it is equivalent to the state in which the capacitance is loaded on the open end 4*a* of the slot 4, and the resonance frequency of the antenna device 10 is shifted to a lower frequency side. At this time, the value of the capacitance generated by the stub 5 is mainly determined by the stub length L, and is less affected by the thickness of the dielectric substrate 2 or relative permittivity of the dielectric forming the dielectric substrate 2.

Figure 3:
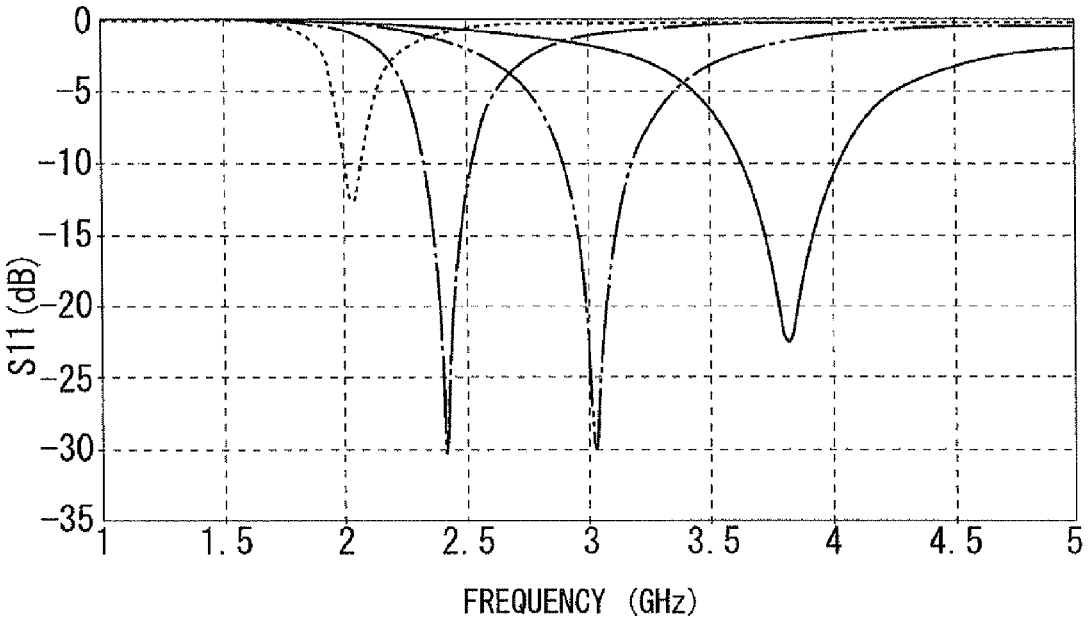
FIG. 3 is a diagram showing a calculation example of impedance characteristics of the antenna device according to the first exemplary embodiment of the present invention.

FIG. 3 is a diagram showing a calculation example of impedance characteristics of the antenna device according to the first exemplary embodiment. A change in the stub length L of the open-end stub 5 causes a change in the impedance characteristics of the antenna device as shown in FIG. 3.

As stated above, by changing the stub length L to control the capacitance loaded on the open end 4*a* of the slot 4, it is possible to adjust the resonance frequency of the antenna device 10 with high accuracy without changing the dimension of the slot 4. In short, it is possible to obtain a desired resonance frequency of the antenna device with the slot 4 of smaller dimension. While the antenna device includes a single dielectric substrate 2 in the first exemplary embodiment, it is not limited to this example and may have a configuration of a multi-layered substrate in which a plurality of dielectric substrates 2 are laminated.

As described above, the antenna device 10 according to the first exemplary embodiment has a structure of adjusting the stub length L of the stub 5 to control the capacitance loaded on the antenna device 10. It is therefore possible to reduce the influences given to the resonance frequency of the antenna device 10 due to the variations of the thickness of the dielectric substrate 2 or the relative permittivity of the dielectric, thereby being able to adjust the resonance frequency with high accuracy.

Since the conductor pattern of the stub 5 can be manufactured by a process of manufacturing a typical printed wiring board, it is possible to adjust the dimension of the stub 5 with high accuracy and to greatly suppress the variation of the stub length L. In summary, it is possible to suppress the variation of the capacitance generated by the stub 5 and to control the resonance frequency of the antenna device with high accuracy.

Further, while the conductor pattern of the stub 5 preferably has a linear shape as shown in FIG. 1, it may have another shape as long as the above stub length is satisfied. Even when the stub 5 is bent so as not to contact other mounted components or end parts of the substrate, for example, it does not have any influence on the essential effects of the present invention.

It is possible to integrally form the antenna device 10 and the radio circuit 8 on one printed wiring board. It is therefore possible to reduce the mounting space and to reduce the cost of manufacturing the antenna device 10. Further, since there is no need to draw the coaxial cable 7, it is possible to prevent reduction in a radio performance due to power loss, unwanted radiations, or electromagnetic interference with other circuits or function elements, due to the coaxial cable 7.

Second Exemplary Embodiment

Figure 4:
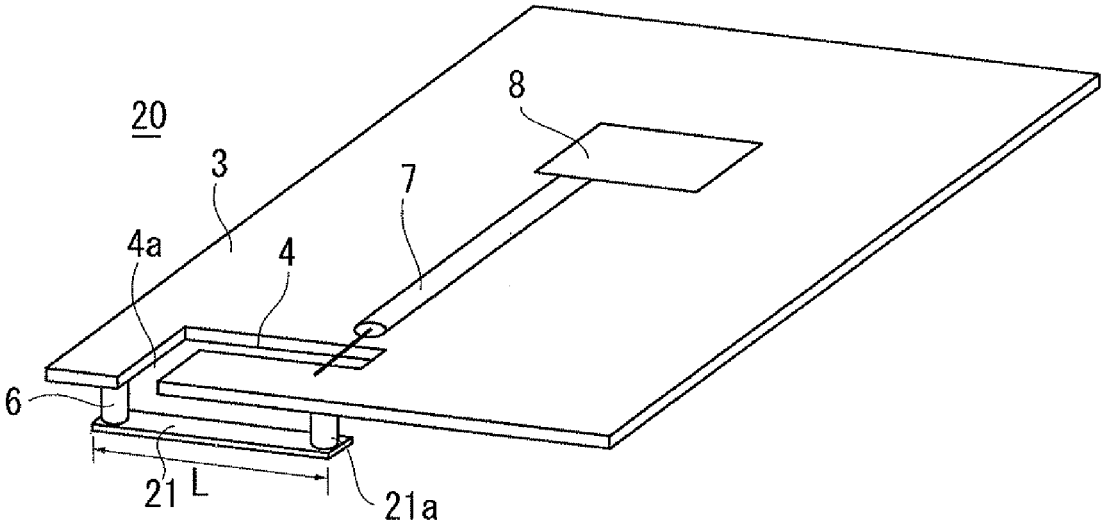
FIG. 4 is a perspective view showing a stub arranged in a slot open end of a conductor plate of an antenna device according to a second exemplary embodiment of the present invention.
Figure 5:
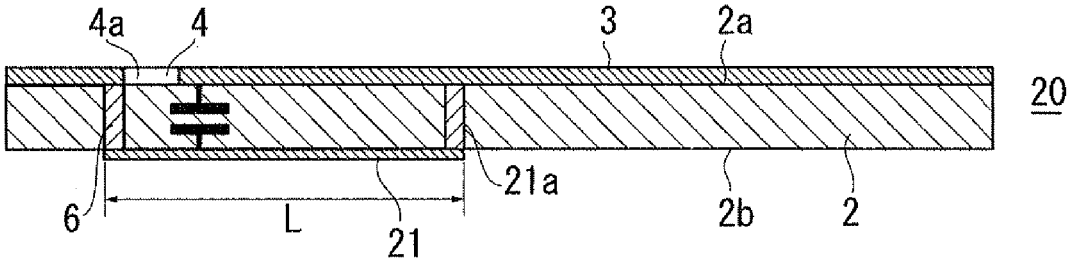
FIG. 5 is a cross-sectional view showing a schematic configuration of the antenna device according to the second exemplary embodiment of the present invention.

FIG. 4 is a perspective view showing a stub arranged in a slot open end of a conductor plate of an antenna device according to a second exemplary embodiment of the present invention. FIG. 5 is a cross-sectional view showing a schematic configuration of the antenna device according to the second exemplary embodiment of the present invention.

In the antenna device 20 according to the second exemplary embodiment, a stub 21 arranged in the open end 4*a* of the slot 4 is short ended in which the other end 21*a* of the slot 4 is short-circuited to the conductor plate 3. When the wavelength corresponding to the frequency to be used is represented by λ, the stub length L satisfies $\lambda/4<L<\lambda/2$. Since the other configurations of the antenna device 20 according to the second exemplary embodiment are substantially the same as those of the antenna device 10 according to the first exemplary embodiment, the same components are denoted by the same reference symbols and the detailed descriptions will be omitted.

When the stub length L of the stub 21 arranged in the open end 4*a* of the slot 4 is set so as to satisfy $\lambda/4<L<\lambda/2$ in the antenna device 20 formed as described above, it is equivalent to the state in which the capacitance is loaded on the open end 4*a* of the slot 4, and the resonance frequency of the antenna device 20 is shifted to a lower frequency side.

Accordingly, similarly to the antenna device 10 according to the first exemplary embodiment, the antenna device 20 according to the second exemplary embodiment also changes the stub length L to control the capacitance loaded on the open end 4*a* of the slot 4, whereby it is possible to adjust the resonance frequency of the antenna device 20 with high accuracy without changing the dimension of the slot 4. In short, it is possible to obtain a desired resonance frequency of the antenna device 20 with the slot 4 of smaller dimension.

Further, in the antenna device 20 according to the second exemplary embodiment, similarly to the antenna device 10 according to the first exemplary embodiment, the value of the capacitance generated by the stub 21 is determined by the stub length L, and is less influenced by the thickness of the dielectric substrate 2 or the relative permittivity of the dielectric. Furthermore, since the conductor pattern of the stub 21 may be realized by a process of manufacturing a typical printed wiring board, the variation of the stub length L may be greatly suppressed. In summary, it is possible to suppress the variation of the capacitance generated by the stub 21 and to control the resonance frequency of the antenna device 20 with high accuracy.

Third Exemplary Embodiment

Figure 6:
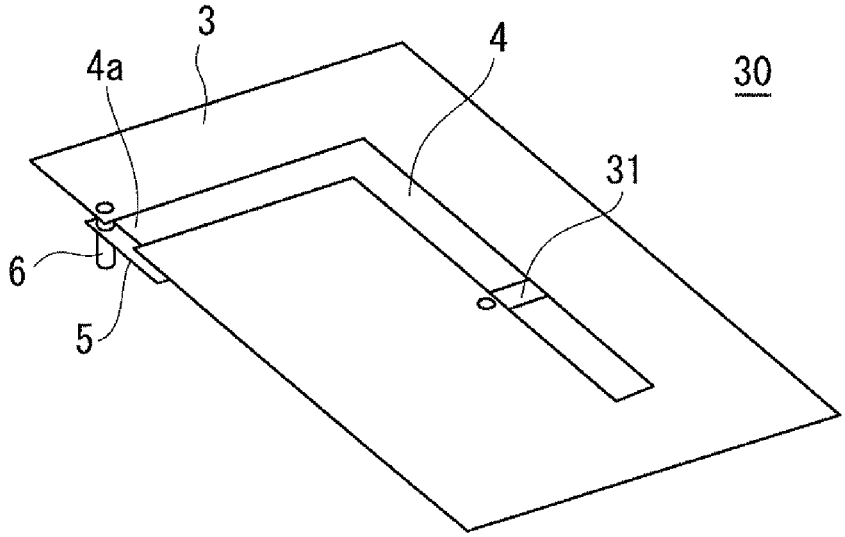
FIG. 6 is a perspective view showing a plurality of stubs arranged in respective slots of a conductor plate of an antenna device according to a third exemplary embodiment of the present invention, and is a view seen from above.
Figure 7:
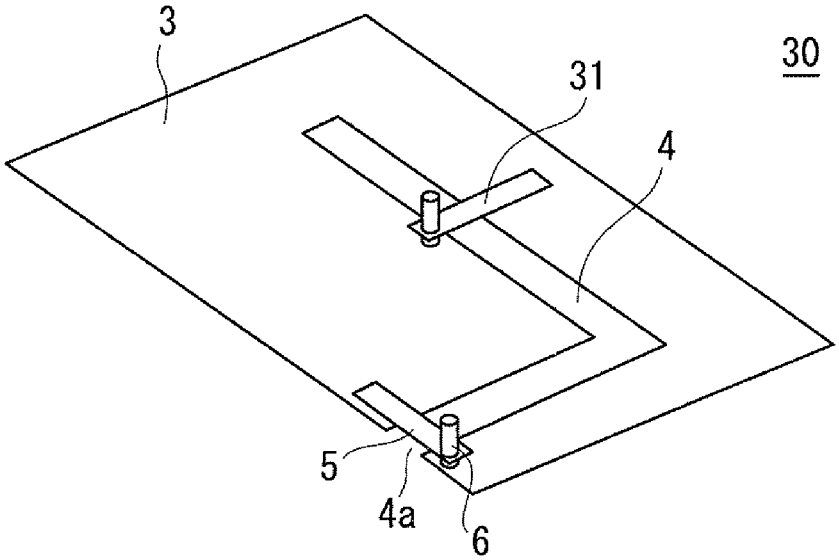
FIG. 7 is a perspective view showing a plurality of stubs arranged in the respective slots of the conductor plate of the antenna device according to the third exemplary embodiment of the present invention, and is a view seen from below.

FIG. 6 is a perspective view showing a plurality of stubs arranged in respective slots of a conductor plate of an antenna device according to a third exemplary embodiment of the present invention, and is a view seen from above. FIG. 7 is a perspective view showing a plurality of stubs arranged in the respective slots of the conductor plate of the antenna device according to the third exemplary embodiment of the present invention, and is a view seen from below.

An antenna device 30 according to the third exemplary embodiment further includes an open-end stub 31 at a location spaced apart from the stub 5 by a predetermined distance in addition to the open-end stub 5 arranged in the open end 4*a* of the slot 4. The stub 31 is arranged at the location spaced apart from the open end 4*a* of the slot 4 by about two-thirds of the slot length.

As an example, the stub 5 is arranged in the open end 4*a* of the slot 4, and the stub 31 is arranged at the location spaced apart from the open end 4*a* of the slot 4 by about two-thirds of the slot length. The stub 31 is a plate-like material having an elongated linear shape, similarly to the stub 5, and is formed to cross the slot 4. While the stubs 5 and 31 are open at distal ends, they may have other shapes and may be shorted at distal ends.

Since the other configurations of the antenna device 30 according to the third exemplary embodiment are substantially similar to those of the antenna device 10 according to the first exemplary embodiment, the same components are denoted by the same reference symbols and the detailed descriptions will be omitted.

Figure 8:
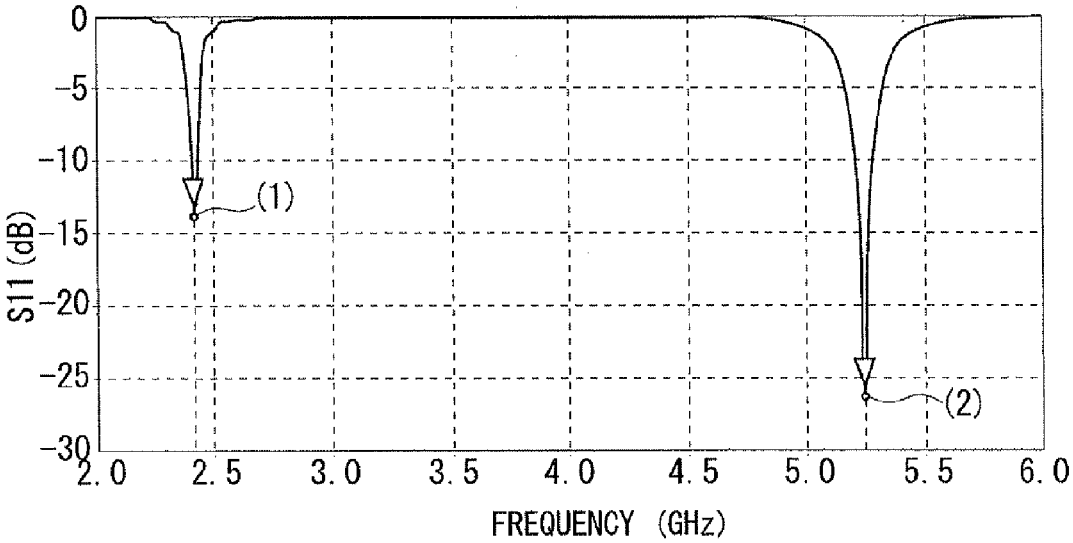
FIG. 8 is a diagram showing a calculation example of impedance characteristics of the antenna device according to the third exemplary embodiment of the present invention.

FIG. 8 is a diagram showing a calculation example of impedance characteristics of the antenna device according to the third exemplary embodiment. In FIG. 8, the electric field of the antenna device 30 in a low-frequency side resonance frequency (1) has a standing wave distribution so that, when the wavelength corresponding to the resonance frequency (1) is represented by $\lambda_1$, the electric field of the open end 4*a* of the slot 4 becomes an antinode and the electric field of the location spaced apart from the open end 4*a* of the slot 4 by $\lambda_1/4$ becomes a node. Meanwhile, the electric field of the antenna device 30 in a high-frequency side resonance frequency (2) has a standing wave distribution so that, when the wavelength corresponding to the resonance frequency (2) is represented by $\lambda_2$, the electric field of the open end 4*a* of the slot 4 and the location spaced apart from the open end 4*a* of the slot 4 by $\lambda_2/2$ becomes an antinode and the electric field of the locations spaced apart from the open end 4*a* of the slot 4 by $\lambda_2/4$ and $3/4\lambda_2$ becomes a node. Since the total length of the slot 4 at this time is $\lambda_2\times3/4$, the location which is to be an antinode of the electric field corresponds to the location of about two-thirds of the length of the slot 4 from the open end 4*a*.

The stubs 5 and 31 are arranged at the open end 4*a* of the slot 4 and the location spaced apart from the open end 4*a* of the slot 4 by $\lambda_2/2$ (the location spaced apart from the open end 4*a* of the slot 4 by about two-thirds of the slot length) which are the antinode of the standing wave distribution, respectively. In this case, when the stub length L of the stub 5 arranged in the open end 4*a* of the slot 4 is adjusted, both of the low-frequency side resonance frequency (1) and the high-frequency side resonance frequency (2) shown in FIG. 8 are changed. Meanwhile, when the stub length L of the stub 31 is adjusted, only the high-frequency side resonance frequency mainly changes.

Accordingly, a method of adjusting the resonance frequency in the antenna device 30 according to the third exemplary embodiment is as follows. That is, the stub length L of the stub 5 arranged in the open end 4*a* of the slot 4 is first adjusted to adjust the low-frequency side to a desired resonance frequency. Next, the stub length L of the stub 31 arranged at the location spaced apart from the open end 4*a* of the slot 4 by $\lambda_2/2$ (the location spaced apart from the open end 4*a* of the slot 4 by about two-thirds of the slot length) is adjusted to adjust the high-frequency side to a desired resonance frequency.

As described above, in the antenna device 30 according to the third exemplary embodiment, it is possible to achieve multiple resonances with only one slot 4 without changing the dimensions of the slot 4, thereby being able to substantially reduce the size of the antenna device 30. In this case, since there is no need to use a chip capacitor to reduce the size of the antenna device 30, the number of components can be reduced, which leads to cost reduction. Further, by controlling the stub length L of each of the stubs 5 and 31, the plurality of resonance frequencies can be easily adjusted independently, thereby being able to reduce the number of steps for adjusting the frequency.

While the antenna device 30 according to the third exemplary embodiment has a configuration in which two stubs 5 and 31 are arranged in the slot 4, it is not limited to this example. For example, three or more stubs may be arranged in the slot 4.

While each of the stubs 5 and 31 arranged in the slot 4 has an elongated linear shape in the antenna device 30 according to the third exemplary embodiment, it is not limited to this example. The shape of the stubs 5 and 31 may be any shape as long as the stub length L of the open-end stubs 5 and 31 falls within a range of $L<\lambda/4$ or the stub length L of the short-end stub falls within a range of $\lambda/4<L<\lambda/2$. The shape of the stubs may be, for example, meandering, spiral, or irregular serpentine.

Fourth Exemplary Embodiment

Figure 9:
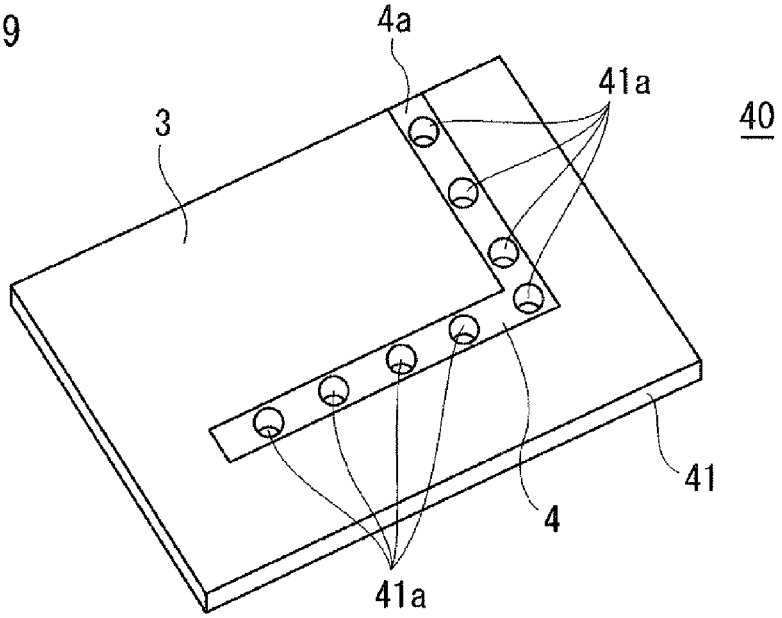
FIG. 9 is a perspective view showing a schematic configuration of an antenna device according to a fourth exemplary embodiment of the present invention.

FIG. 9 is a perspective view showing a schematic configuration of an antenna device according to a fourth exemplary embodiment of the present invention. In an antenna device 40 according to the fourth exemplary embodiment, a plurality of opening holes 41*a* are formed in a dielectric substrate 41 along the slot 4.

Each of the opening holes 41*a* has a diameter smaller than the width of the slot 4, and penetrates from the front surface to the rear surface of the dielectric substrate 41. While eight opening holes 41*a* are arranged in the dielectric substrate 41 substantially at regular intervals, it is not limited to this example and the number and the locations of the opening holes 41*a* that are arranged may be arbitrarily determined. While the shape of the opening holes is circular in this example, it is not limited to this example and may be any shape such as square, rectangle, or triangle.

Since the other configurations of the antenna device 40 according to the fourth exemplary embodiment are substantially the same as those of the antenna device 10 according to the first exemplary embodiment, the same components are denoted by the same reference symbols and the detailed descriptions will be omitted.

In general, in an antenna device that includes a slot, a strong electric field concentrates in the slot part, which causes power loss due to a dielectric loss tangent that the dielectric substrate has. In order to deal with this, in the antenna device 40 according to the fourth exemplary embodiment, a plurality of opening holes 41*a* are provided in the dielectric substrate 41 along the slot 4. The electric field distribution in the slot 4 becomes weak and it is possible to reduce the power loss due to the dielectric loss tangent.

Fifth Exemplary Embodiment

Figure 10:
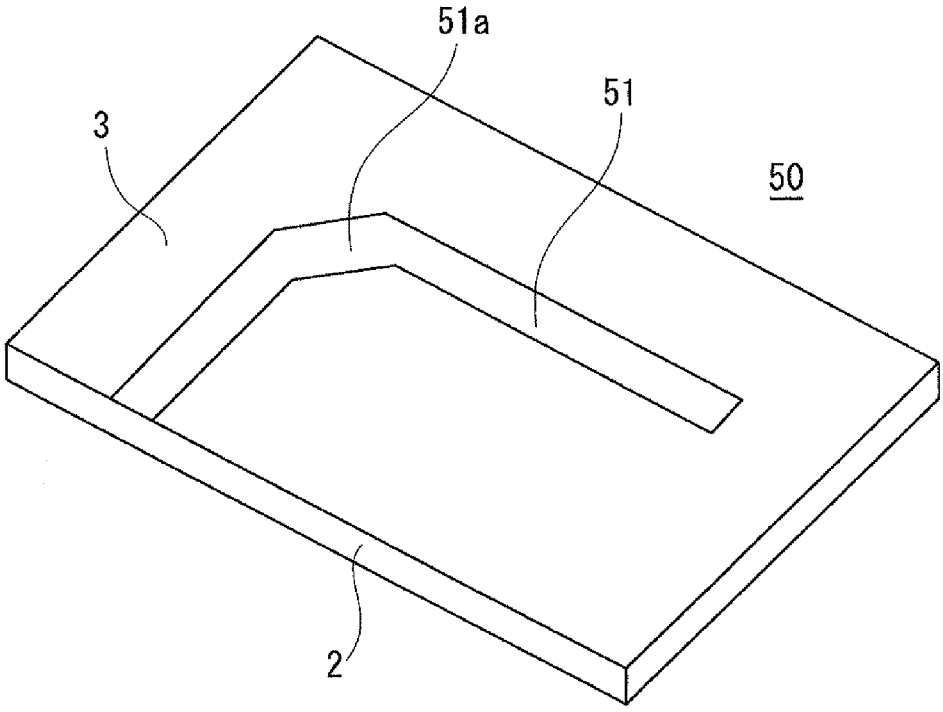
FIG. 10 is a perspective view showing a schematic configuration of an antenna device according to a fifth exemplary embodiment of the present invention.

FIG. 10 is a perspective view showing a schematic configuration of an antenna device according to a fifth exemplary embodiment of the present invention. In an antenna device 50 according to the fifth exemplary embodiment, a slot 51 formed substantially in an L shape has a corner part 51*a* that is obliquely bent.

Since the other configurations of the antenna device 50 according to the fifth exemplary embodiment are substantially the same as those of the antenna device 10 according to the first exemplary embodiment, the same components are denoted by the same reference symbols and the detailed descriptions will be omitted.

In general, in an antenna device including a slot, resonance currents of the antenna device are distributed in conformity with the slot shape. When the slot is L-shaped, however, the impedance presented by the slot becomes discontinuous at a corner part which is bent at a right angle and the current is reflected. This reflection current acts to weaken the resonance current of the antenna device, which reduces the radiation characteristics of the antenna device.

In order to address this problem, the corner part 51*a* of the slot 51 is obliquely bent in the antenna device 50 according to the fifth exemplary embodiment. As a result, the impedance discontinuity presented by the slot 51 is mitigated, and the current reflection is suppressed, whereby the radiation characteristics of the antenna device 50 are improved.

Sixth Exemplary Embodiment

Figure 11:
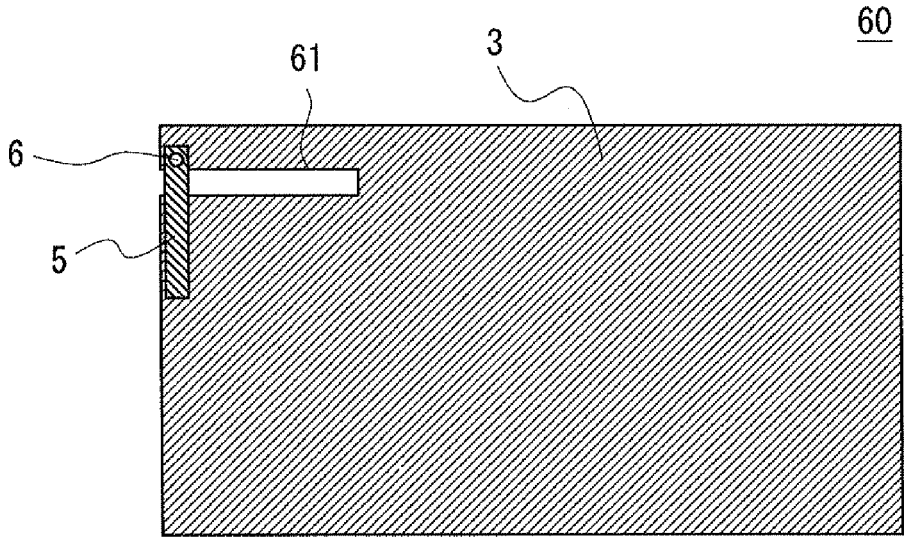
FIG. 11 is a plane view showing a schematic configuration of an antenna device according to a sixth exemplary embodiment of the present invention.

FIG. 11 is a plane view showing a schematic configuration of an antenna device 60 according to a sixth exemplary embodiment of the present invention. In the antenna device 60 according to the sixth exemplary embodiment, a slot 61 has a linear shape. Since the other configurations of the antenna device 60 according to the sixth exemplary embodiment are substantially the same as those of the antenna device 10 according to the first exemplary embodiment, the same components are denoted by the same reference symbols and the detailed descriptions will be omitted.

By forming the slot 61 in a linear shape, the path of the current flowing around the slot 61 is unlikely to be disturbed and an impedance discontinuity is unlikely to occur. It is therefore possible to suppress the current reflection and to improve the radiation characteristics of the antenna device 60.

Note that the shape of the slot 61 does not necessarily have to be perfectly linear. As a matter of course, even when a part of the slot 61 or the whole part of the slot 61 is curved so as not to disturb the current path, for example, it does not have any influence on the essential effects of the present invention.

Figure 12:
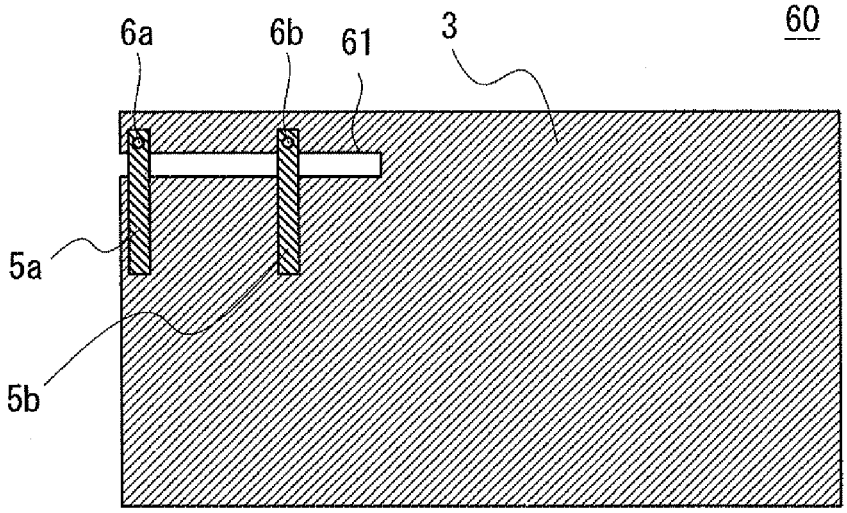
FIG. 12 is a plane view showing a configuration in which two stubs are arranged in a slot.

Similar to the third exemplary embodiment, a plurality of stubs 5 may be arranged in the sixth exemplary embodiment as well. As shown in FIG. 12, for example, two stubs 5*a* and 5*b* may be arranged in the slot 61. Similar to the third exemplary embodiment, in this configuration as well, a plurality of resonance frequencies can be independently adjusted, whereby the antenna device 60 according to the sixth exemplary embodiment can be used as a multi-band antenna operated at a plurality of communication frequencies.

While the configuration in which the two stubs 5*a* and 5*b* are arranged in the slot 61 has been shown in FIG. 12, it is not limited to this example. Three or more stubs 5 may be arranged, for example, similarly to the third exemplary embodiment.

While the configuration in which open-end stubs are used based on the first exemplary embodiment has been described in the examples in FIGS. 11 and 12, it is not limited to this example. A configuration in which short-end stubs are used based on the second exemplary embodiment may be employed, for example.

Seventh Exemplary Embodiment

Figure 13:
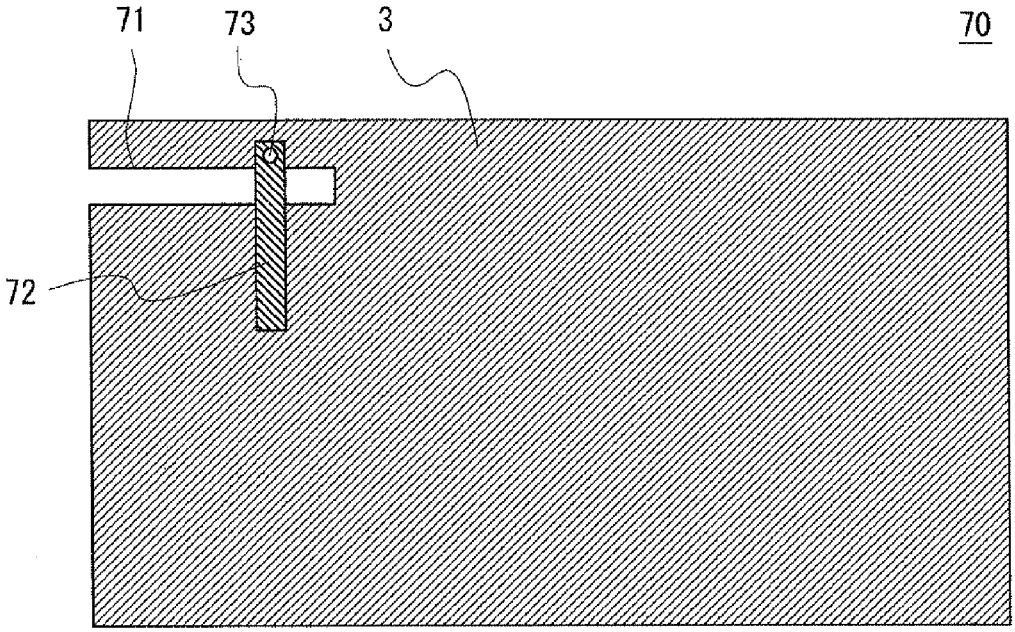
FIG. 13 is a plane view showing a schematic configuration of an antenna device according to a seventh exemplary embodiment of the present invention.

FIG. 13 is a plane view showing a schematic configuration of an antenna device 70 according to a seventh exemplary embodiment of the present invention. In the antenna device 70 according to the seventh exemplary embodiment, a stub 72 is arranged at the location spaced apart from an open end of a slot 71 by a predetermined distance. Since the other configurations of the antenna device 70 according to the seventh exemplary embodiment are substantially the same as those of the antenna device 10 according to the first exemplary embodiment, the same components are denoted by the same reference symbols and the detailed descriptions will be omitted.

The stub 72 functions as a large capacitance in a location where the intensity of the electric field of the slot 71 is high, i.e., a location which is close to the antinode of the resonance, thereby being able to greatly reduce the resonance frequency.

While the location of the antinode of the resonance differs depending on the resonant mode, the open end of the slot is generally at the location of the antinode for all resonant modes. Accordingly, in the first to sixth exemplary embodiments in which the stub 5 is provided in the open end 4*a* of the slot 4, it is possible to lower the frequency of all the resonant modes.

Meanwhile, in the antenna device 70 according to the seventh exemplary embodiment, the stub 72 is located at the location spaced apart from the open end by a predetermined distance. It is therefore possible to lower the frequency of only a specific resonant mode where the location of the stub 72 and the location of the antinode of the resonance are close to each other.

When the stub 72 is arranged at the location spaced apart from the open end of the slot 71 by about two-thirds of the slot length, for example, the stub 72 does not have a great influence on the resonance frequency for a first resonance (1/4 wavelength resonance) since it is close to the node of the electric field. Meanwhile, the stub 72 acts to reduce the resonance frequency for a second resonance (3/4 wavelength resonance) since it is close to the antinode of the electric field. In short, it is possible to mainly reduce only the second resonance frequency without substantially changing the first resonance frequency. In general, a reduced resonant mode has a narrow bandwidth. It is therefore possible to prevent the bandwidth of the first resonance from narrowing by selectively reducing the frequency of only the second resonance.

The antenna device 70 according to the seventh exemplary embodiment may be implemented as a multi-band antenna with the relatively wide-band first resonance. Further, the antenna device 70 may be manufactured by a process of manufacturing a typical printed wiring board, whereby it is possible to greatly suppress the variation of the stub length. In summary, it is possible to suppress the variation of the capacitance generated by the stub 72 and to control the resonance frequency of the antenna device 70 with high accuracy.

Next, an example which is a variation of the antenna device 70 according to the seventh exemplary embodiment will be described.

While the stub 72 is arranged at the location spaced apart from the open end of the slot 71 by about two-thirds of the slot length in the above seventh exemplary embodiment, it is not limited to this configuration and the stub 72 may be arranged at a location spaced apart from the open end of the slot 71 by an arbitrary distance.

The stub 72 may be arranged, for example, at the location spaced apart from the open end of the slot 71 by about 2/5 or about 4/5 of the slot length. In this case, the location of the stub 72 is close to the antinode of a third resonance (5/4 wavelength resonance), and it is thus possible to reduce a third resonance frequency. Note that the stub 72 is not necessarily arranged strictly in these locations, and the resonance frequency can be reduced even when the stub 72 is deviated.

Figure 14:
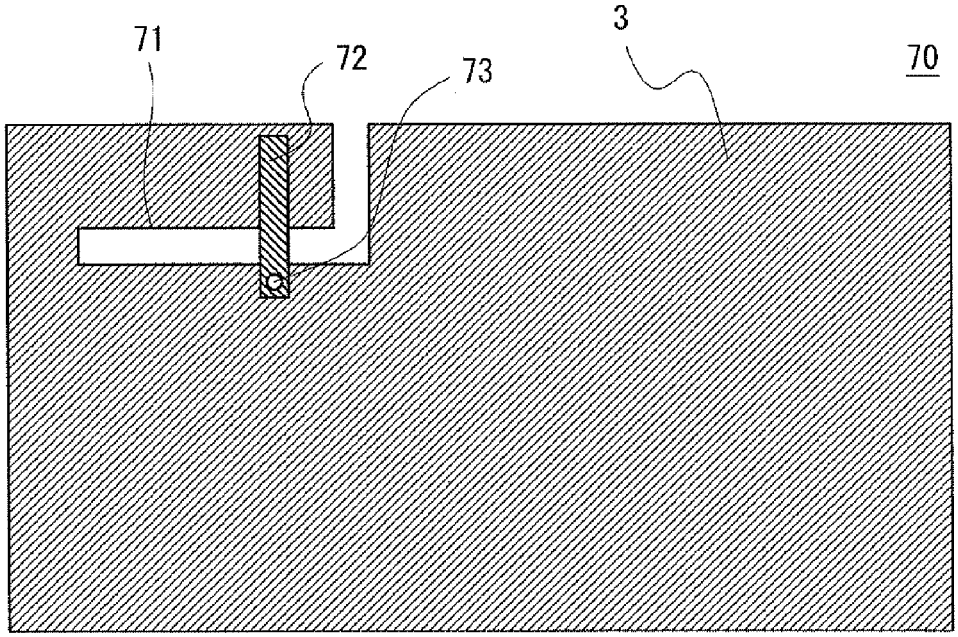
FIG. 14 is a plane view showing a configuration in which an L-shaped slot is provided.

While the linear slot 71 is arranged in the seventh exemplary embodiment, it is not limited to this example. An L-shaped slot 71 may be arranged, for example, as shown in FIG. 14. In this case as well, the similar effect can be obtained.

Figure 15:
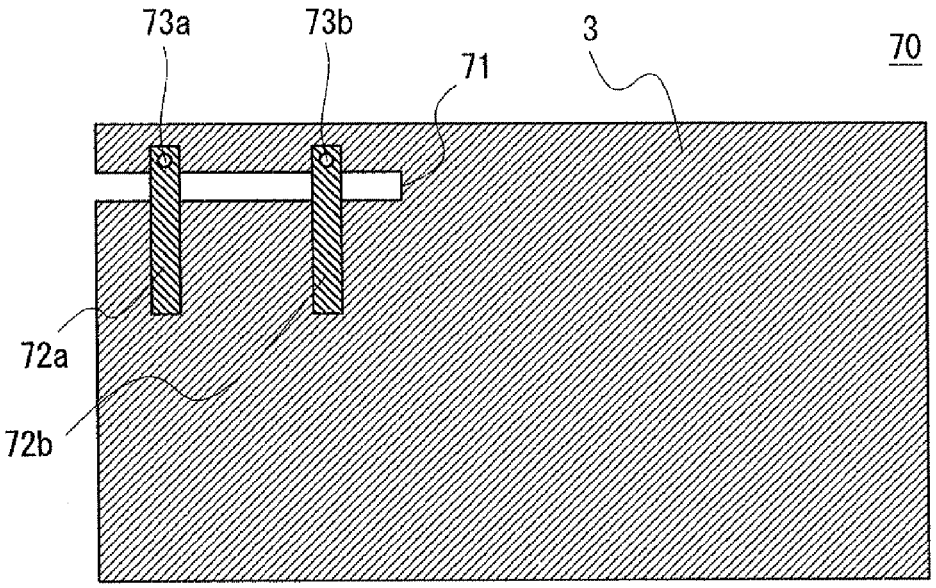
FIG. 15 is a plane view showing a configuration in which two stubs are arranged in a slot.

Furthermore, in the above seventh exemplary embodiment, similarly to the third exemplary embodiment, a plurality of stubs 72 may be arranged in the slot 71. As shown in FIG. 15, two stubs 72*a* and 72*b* may be arranged, for example, in the slot 71. In this case as well, similarly to the third exemplary embodiment, a plurality of resonance frequencies can be adjusted. It is possible to use the antenna device 70 according to the seventh exemplary embodiment as a multi-band antenna which operates at a plurality of communication frequencies. While two subs 72*a* and 72*b* are arranged in the slot 71 as shown in FIG. 15, three or more stubs 72 may be arranged in the slot 71 similar to the third exemplary embodiment.

While the open-end stub 72 is used in the seventh exemplary embodiment, it is not limited to this example and the short-end stub 72 may be used similar to the second exemplary embodiment.

Eighth Exemplary Embodiment

Figure 16:
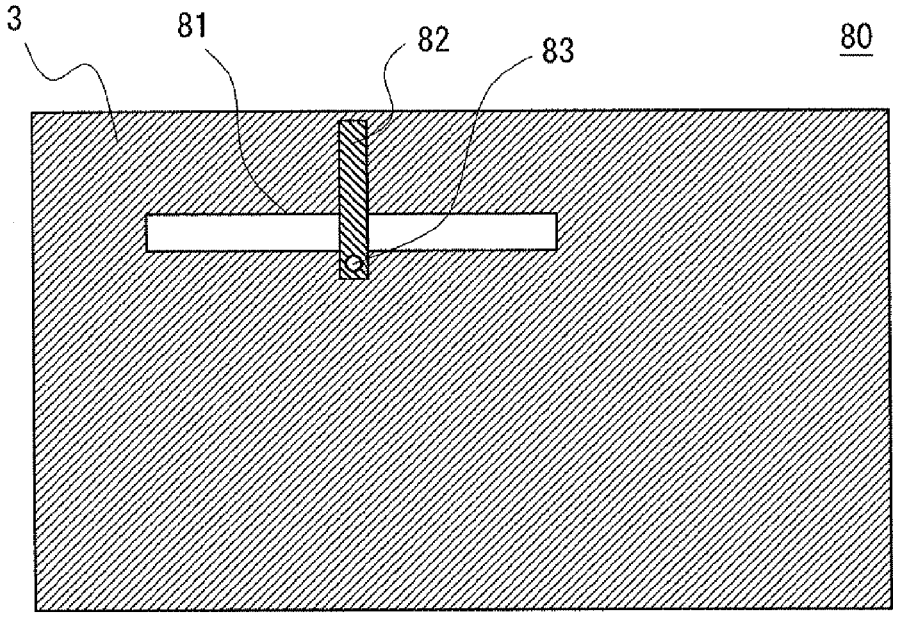
FIG. 16 is a plane view showing a schematic configuration of an antenna device 80 according to an eighth exemplary embodiment of the present invention.
Figure 17:
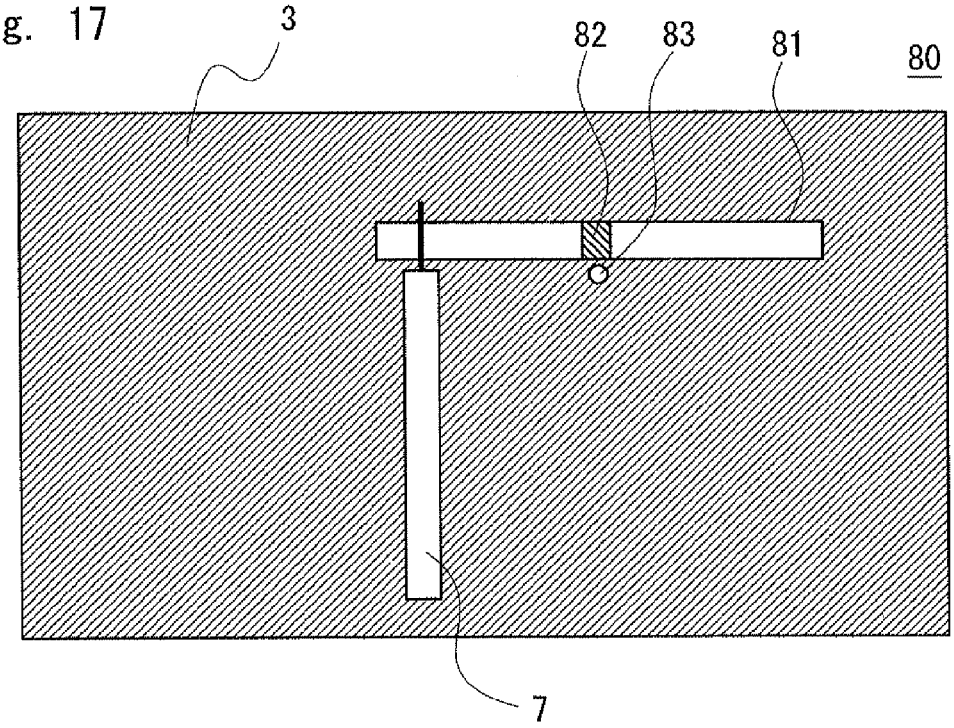
FIG. 17 is a plane view of the antenna device according to the eighth exemplary embodiment of the present invention when seen from the rear side.

FIG. 16 is a plane view showing a schematic configuration of an antenna device 80 according to an eighth exemplary embodiment of the present invention. FIG. 17 is a plane view of the antenna device 80 according to the eighth exemplary embodiment when seen from the rear side.

In the antenna device 80 according to this exemplary embodiment, both ends of a slot 81 are short-circuited. Since the other configurations of the antenna device 80 according to the eighth exemplary embodiment are substantially the same as those of the antenna device 10 according to the first exemplary embodiment, the same components are denoted by the same reference symbols and the detailed descriptions will be omitted.

Since both ends of the slot 81 are short-circuited, a 1/2 wavelength resonance is generated where both ends of the slot 81 becomes a node of the electric field. The antenna device 80 includes a stub 82 similar to the above exemplary embodiments, thereby being able to reduce the resonance frequency generated in the slot 81.

As shown in FIG. 17, an external conductor (first conductor) and an internal conductor (second conductor) of the coaxial cable 7 are connected to the conductor plate 3 on both sides of the slot 81 so as to cross the slot 81. In this way, as completely similar to the antenna device 10 according to the first exemplary embodiment, the antenna device 80 according to the eighth exemplary embodiment is able to feed the slot 81.

Further, since the antenna device 80 according to the eighth exemplary embodiment uses the 1/2 wavelength resonance, the size of the antenna device 80 is doubled compared to the antenna devices 10 to 70 according to the first to seventh exemplary embodiments that use the 1/4 wavelength resonance. Meanwhile, an area contributing to the radiation increases, thereby being able to improve the radiation efficiency.

Further, as shown in FIG. 16 and FIG. 17, the stub 82 is arranged at the center of the slot 81. According to this configuration, the stub 82 acts to reduce the resonance frequency for a first resonance (1/2 wavelength resonance) since it is close to the antinode of the electric field. Meanwhile, the stub 82 does not have any influence on the resonance frequency for a second resonance (1 wavelength resonance) since it corresponds to the node of the electric field. In short, it is possible to mainly reduce the first resonance frequency without substantially changing the second resonance frequency. In general, a reduced resonant mode has a narrow band. It is thus possible to prevent the band of the second resonance from being narrowed by selectively reducing the frequency of only the first resonance. It is therefore possible to obtain the multiband antenna device 80 with a relatively wide-band second resonance.

Furthermore, the antenna device 80 according to this exemplary embodiment can be manufactured in a process of manufacturing a typical printed wiring board, thereby being able to greatly suppress the variation of the stub length. In summary, it is possible to suppress the variation of the capacitance generated in the stub 82 and to control the resonance frequency of the antenna device 80 with high accuracy.

Figure 18:
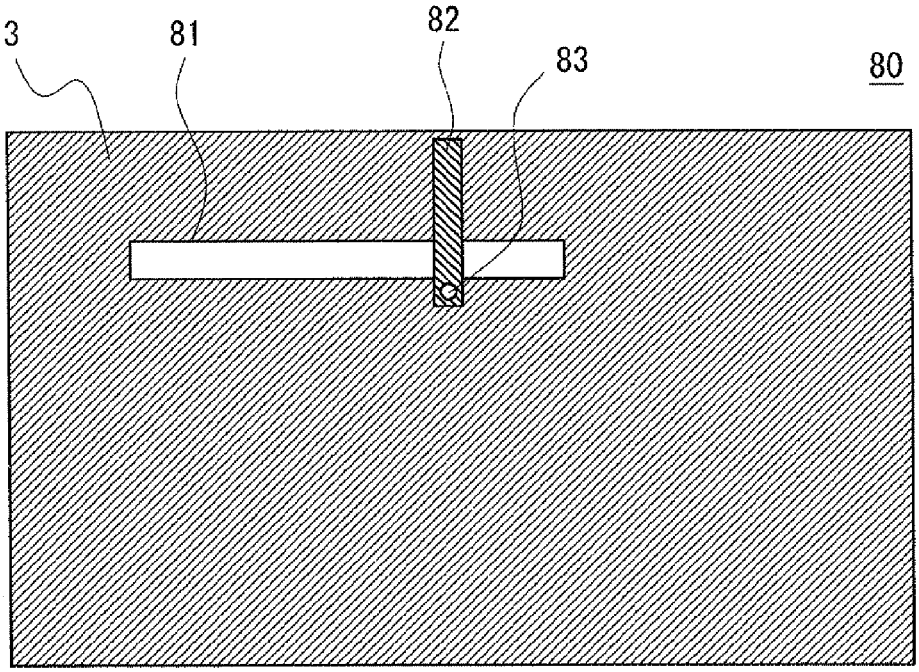
FIG. 18 is a plane view showing a configuration in which a stub is arranged in a location which is not the center of a slot.

Further, as shown in FIG. 18, the eighth exemplary embodiment may have a configuration in which the stub 82 is provided at a location which is not the center of the slot 81. In this case, the frequency of only a specific resonant mode in which the location of the stub 82 and the location of the antinode of the resonance are close to each other can be reduced.

When the stub 82 is arranged at the location spaced apart from the short-circuit end of the slot 81 by about a quarter of the slot length, the stub 82 does not have a great influence on the resonance frequency for a first resonance (1 wavelength resonance) since it is close to the node of the electric field. Meanwhile, the stub 82 acts to reduce the resonance frequency for a second resonance (1/2 wavelength resonance) since it is close to the antinode of the electric field. In summary, it is possible to mainly reduce the second resonance frequency without substantially changing the first resonance frequency.

While the stub 82 is arranged, for example, at the location spaced apart from the short-circuit end of the slot 81 by about a quarter of the slot length in the eighth exemplary embodiment, it is not limited to this example. The stub 82 may be arranged, for example, at the location spaced apart from the short-circuit end of the slot 81 by about 1/6 of the slot length. In this case, the location of the stub 82 is close to the antinode of a third resonance (3/2 wavelength resonance), whereby it is possible to reduce the third resonance frequency. Note that the stub 82 is not necessarily arranged strictly in these locations. Even when the location is deviated, the resonance frequency can be reduced.

While the linear slot 81 is arranged as shown in FIG. 16 to FIG. 18, it is not limited to these examples. An L-shaped slot 81 may be arranged, for example. In this case as well, the similar effect can be obtained.

Further, also in the eighth exemplary embodiment, similarly to the third exemplary embodiment, a plurality of stubs 82 may be arranged. Even in this case as well, similarly to the third exemplary embodiment, a plurality of resonance frequencies can be adjusted, whereby it is possible to use the antenna device 80 according to this exemplary embodiment as a multi-band antenna operated at a plurality of communication frequencies. Furthermore, while the open-end stub 82 is applied in the eighth exemplary embodiment, it is not limited to this example and a short-end stub 82 which is similar to that in the second exemplary embodiment may be applied instead.

Ninth Exemplary Embodiment

Figure 19:
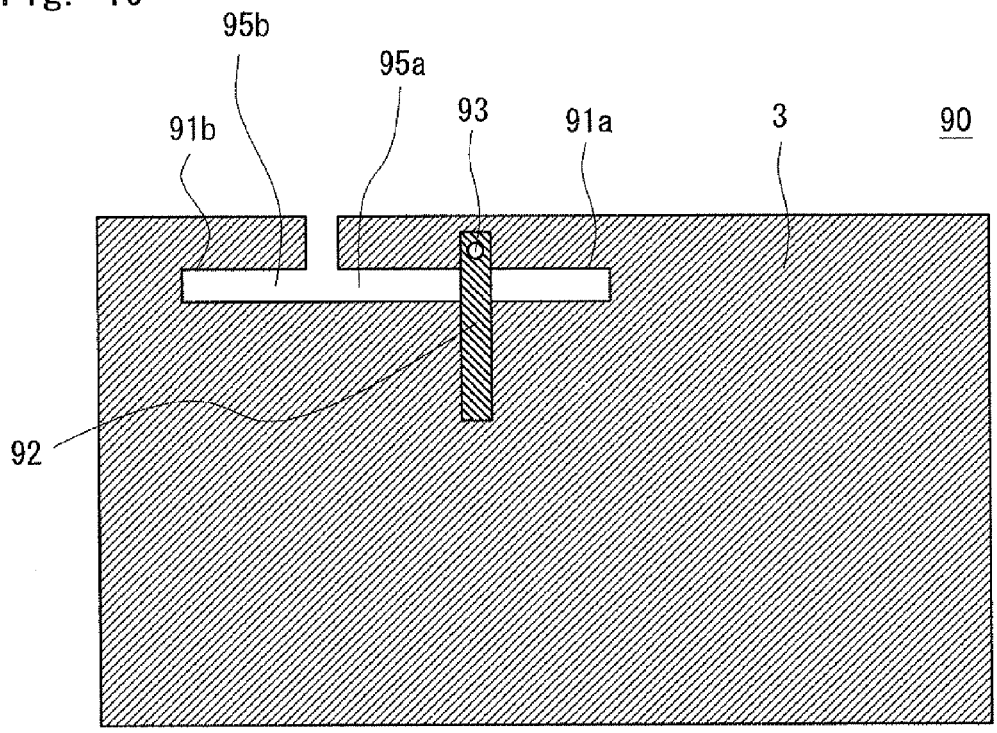
FIG. 19 is a plane view showing a schematic configuration of an antenna device according to a ninth exemplary embodiment of the present invention.
Figure 20:
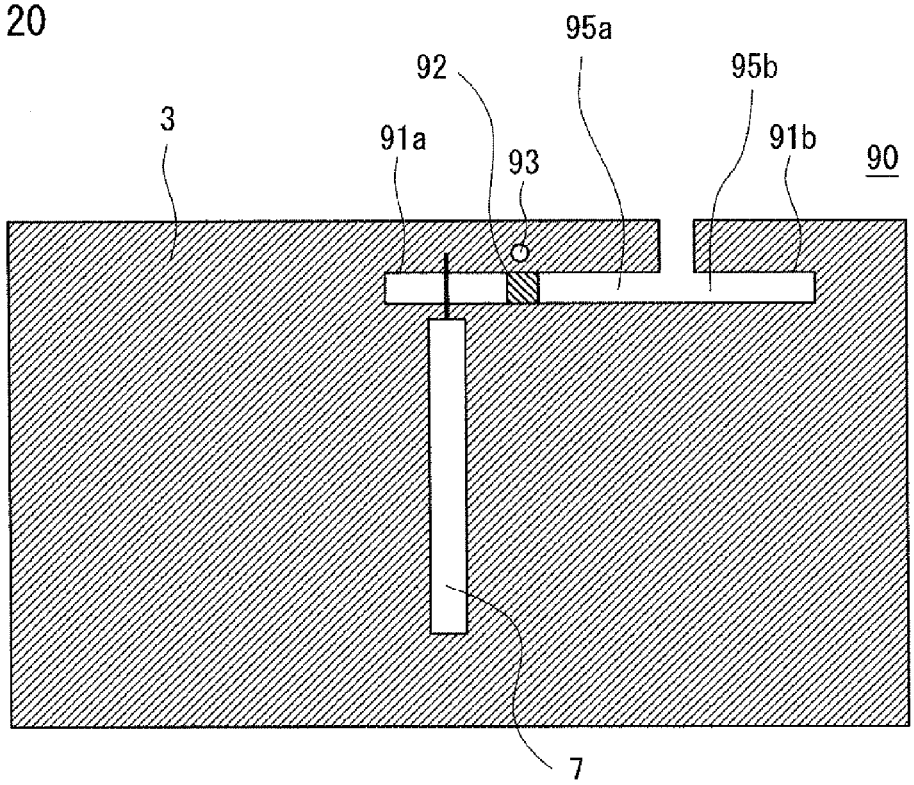
FIG. 20 is a plane view of the antenna device according to the ninth exemplary embodiment of the present invention when seen from the rear side.

FIG. 19 is a plane view showing a schematic configuration of an antenna device 90 according to a ninth exemplary embodiment of the present invention. FIG. 20 is a plane view of the antenna device 90 according to the ninth exemplary embodiment when seen from the rear side.

The antenna device 90 according to the ninth exemplary embodiment is basically similar to the antenna device 70 according to the seventh exemplary embodiment. The antenna device 90 further includes two slots 91*a* and 91*b*, and open ends 95*a* and 95*b* arranged so as to be opposed to each other. Since the other configurations of the antenna device 90 according to the ninth exemplary embodiment are substantially the same as those of the antenna device 70 according to the seventh exemplary embodiment, the same components are denoted by the same reference symbols and the detailed descriptions will be omitted.

In the antenna device 90 according to the ninth exemplary embodiment, an external conductor (first conductor) and an internal conductor (second conductor) of the coaxial cable 7 are connected to the conductor plate 3 on both sides of the slot 91*a* so as to cross the slot 91*a*, thereby being able to feed the slot 91*a*. Further, since a stub 92 is provided to cross the slot 91*a*, the resonance frequency generated in the slot 91*a* can be reduced.

Meanwhile, the slot (second slot) 91*b* opposed to the slot (first slot) 91*a* does not include a structure for achieving direct feeding. However, since the open end 95*a* and the open end 95*b* are electrically coupled, power is indirectly supplied from the slot 91*a* to the slot 91*b*. The slot 91*b* thus contributes to radiation as a parasitic element.

At this time, the resonance frequencies of the slot 91*a* and the slot 91*b* are made close to each other, so that the two slots 91*a* and 91*b* operate as coupled resonators, and the resonance frequencies are split, thereby being able to increase the operating bandwidth. The two resonance frequencies that are split are separated from each other as the coupling between the two slots 91*a* and 91*b* becomes strong. The strength of the coupling between the slots 91*a* and 91*b* may be controlled by the distance between the open ends 95*a* and 95*b*.

Further, the antenna device 90 according to the ninth exemplary embodiment can be manufactured in a process of manufacturing a typical printed wiring board, thereby being able to greatly suppress the variation of the stub length. In summary, it is possible to suppress the variation of the capacitance generated in the stub 92 and to control the resonance frequency of the antenna device 90 with high accuracy.

Figure 21:
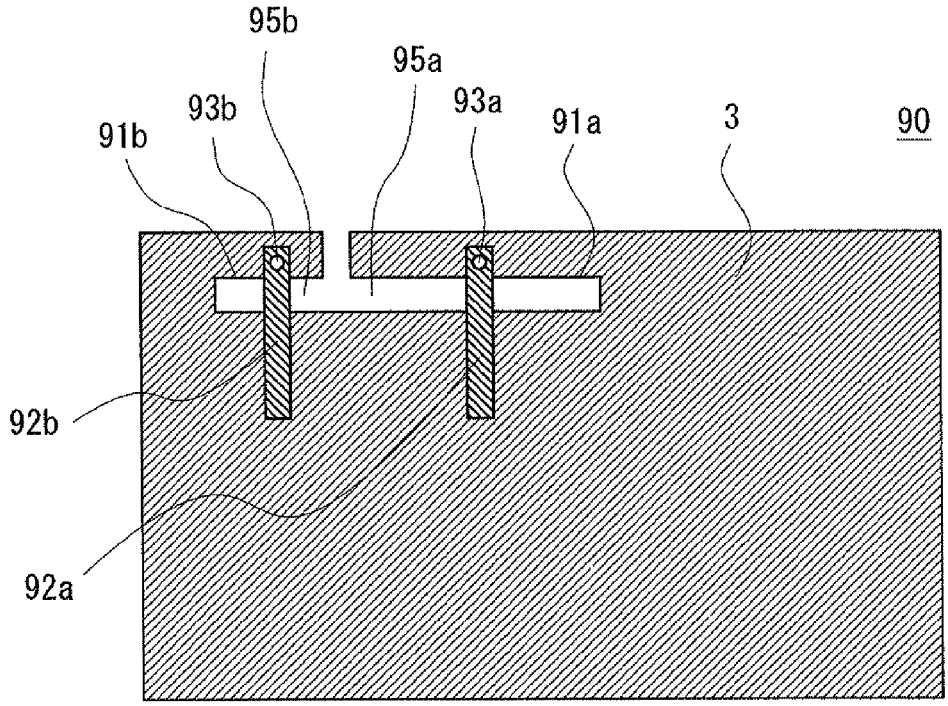
FIG. 21 is a plane view showing a configuration in which a stub is arranged in a slot which is a parasitic element.

Alternatively, as shown in FIG. 21, the resonance frequency of the slot 91*b* may be reduced by providing a stub 92*b* also in the slot 91*b* which is a parasitic element in the ninth exemplary embodiment. Further, while the linear slots 91*a* and 91*b* are applied, it is not limited to this example and one or both slots may be formed, for example, in an L shape or another shape. In this case as well, the similar effect can be obtained. Furthermore, while the open-end stub 92 is applied, it is not limited to this example and the short-end stub 92 may be applied similar to the second exemplary embodiment.

Tenth Exemplary Embodiment

Figure 22:
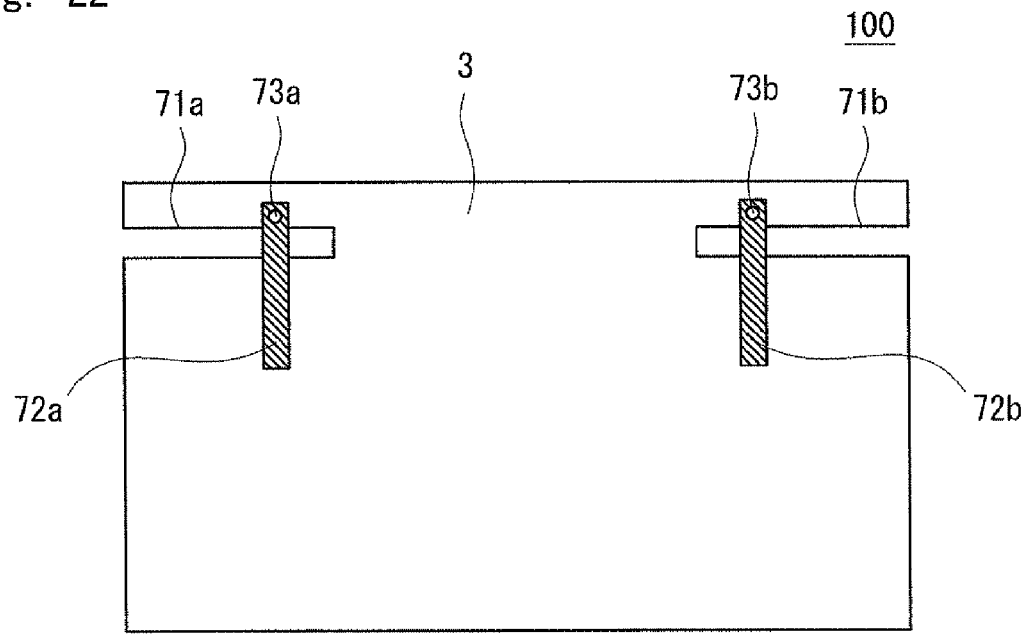
FIG. 22 is a plane view showing a schematic configuration of an antenna device according to a tenth exemplary embodiment of the present invention.
Figure 23:
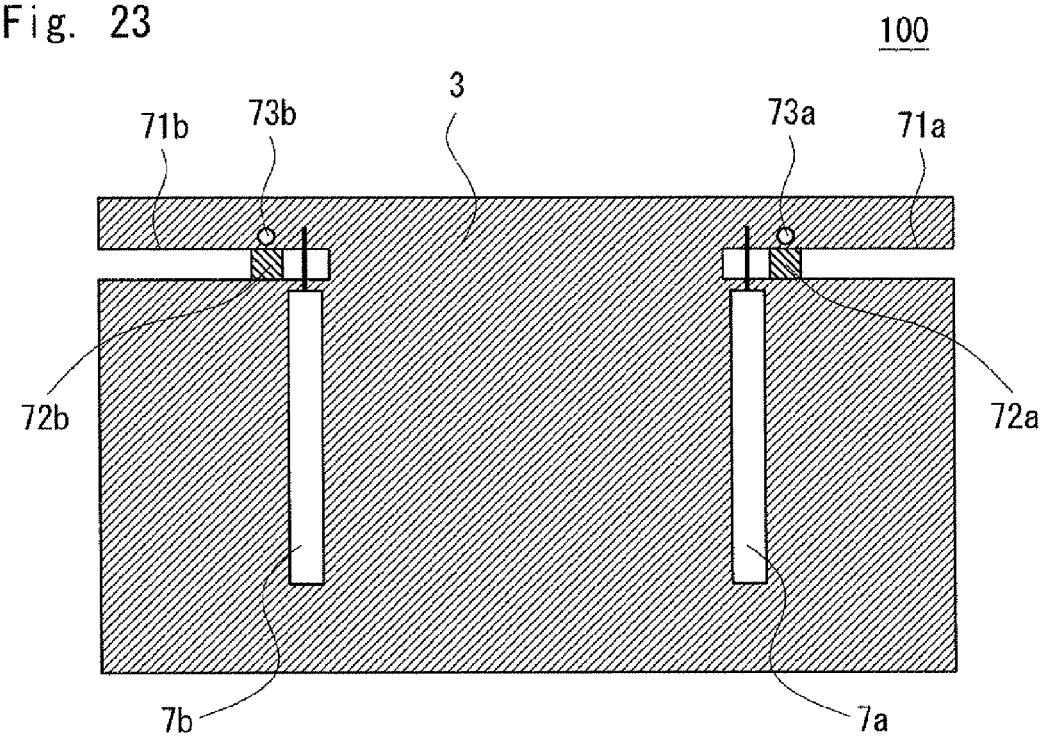
FIG. 23 is a plane view of the antenna device according to the tenth exemplary embodiment of the present invention when seen from the rear side.

FIG. 22 is a plane view showing a schematic configuration of an antenna device 100 according to a tenth exemplary embodiment of the present invention. FIG. 23 is a plane view of the antenna device 100 according to the tenth exemplary embodiment when seen from the rear side.

The antenna device 100 according to the tenth exemplary embodiment is basically similar to the antenna device 70 according to the seventh exemplary embodiment. The antenna device 100 further includes a plurality of slots 71, a plurality of stubs 72, a plurality of vias 73, and a plurality of coaxial cables 7.

The antenna device 100 according to the tenth exemplary embodiment includes, for example, a first slot antenna including a first slot 71*a*, a first stub 72*a*, a first via 73*a*, and a first coaxial cable 7*a* formed in the conductor plate 3, and a second slot antenna including a second slot 71*b*, a second stub 72*b*, a second via 73*b*, and a second coaxial cable 7*b* formed in the conductor plate 3. Since the other configurations of the antenna device 100 according to the tenth exemplary embodiment are substantially the same as those of the antenna device 70 according to the seventh exemplary embodiment, the same components are denoted by the same reference symbols and the detailed descriptions will be omitted.

Figure 24:
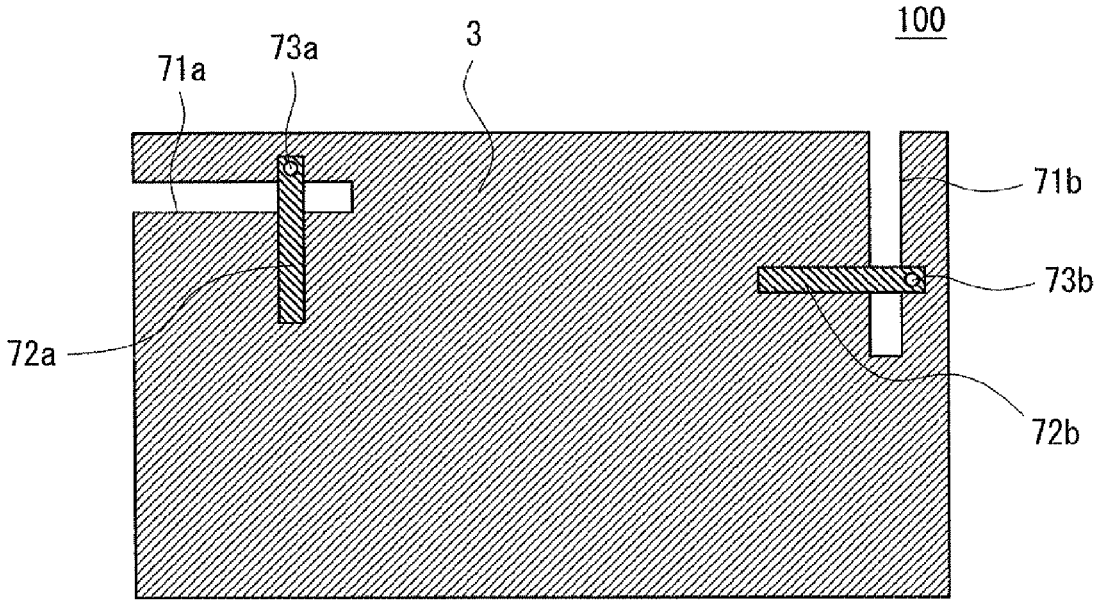
FIG. 24 is a plane view showing a configuration in which directions of slots of first and second antennas are orthogonal to each other.

The antenna device 100 according to the tenth exemplary embodiment may be used, for example, for a communication such as MIMO (Multi-Input-Multi-Output) which requires a plurality of antennas. In order to obtain high throughput in the MIMO, it is desirable that the correlation coefficient between antennas is low. As shown in FIG. 24, the first slot 71*a* of the first slot antenna and the second slot 71*b* of the second slot antenna may be orthogonal to each other to reduce the correlation coefficient between the first and second slot antennas. While the antenna device 100 according to the tenth exemplary embodiment is basically similar to the antenna device 70 according to the seventh exemplary embodiment, it is not limited to this example and may be basically similar to the antenna device in another exemplary embodiment.

Eleventh Exemplary Embodiment

Figure 25:
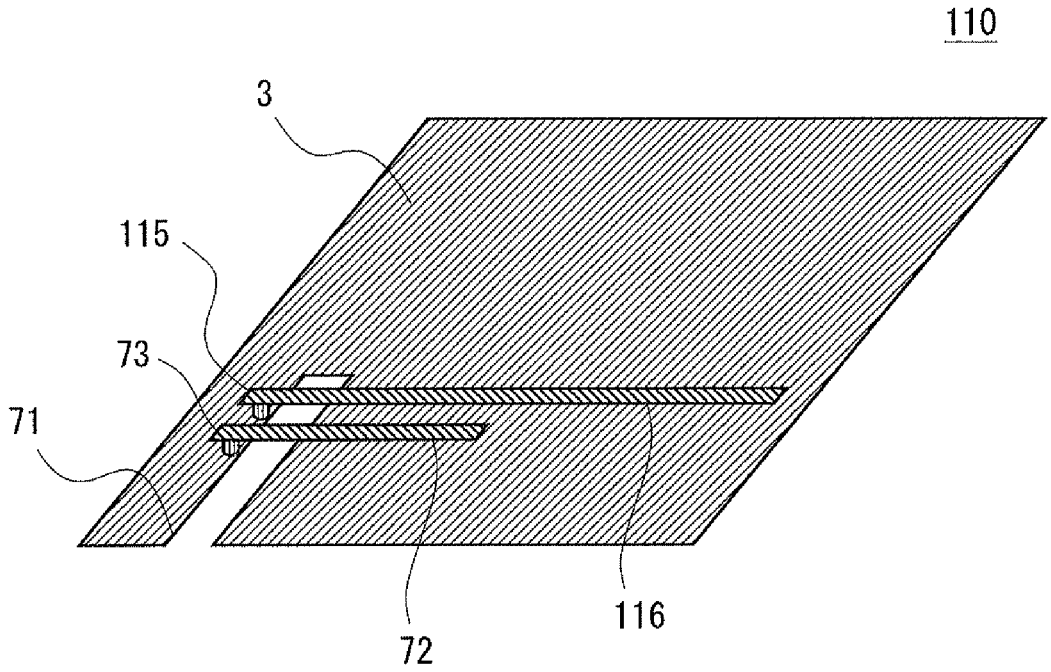
FIG. 25 is a perspective view of an antenna device according to an eleventh exemplary embodiment of the present invention when seen from the rear side.

FIG. 25 is a perspective view of an antenna device 110 according to an eleventh exemplary embodiment of the present invention when seen from the rear side. The antenna device 110 according to the eleventh exemplary embodiment is basically similar to the antenna device 70 according to the seventh exemplary embodiment. In the antenna device 110, a micro-strip line 116 and a feeding via 115 feed the slot 71. Since the other configurations of the antenna device 110 according to the eleventh exemplary embodiment are substantially the same as those of the antenna device 70 according to the seventh exemplary embodiment, the same components are denoted by the same reference symbols and the detailed descriptions will be omitted.

The micro-strip line 16 provided on a surface different from the conductor plate 3 is arranged to cross the slot 71, and one end of the micro-strip line 116 which crosses the slot 71 is connected to a periphery of the slot 71 of the conductor plate 3 by the feeding via 115. Further, the other end of the micro-strip line 116 is connected to the radio circuit 8 (not shown). According to such a configuration, it is possible to feed the slot 71 by the micro-strip line 116 without using the coaxial cable 7.

In the antenna device 110 according to the eleventh exemplary embodiment, the feeding via 115 can be formed in a process of manufacturing a typical printed wiring board, thereby being able to control the feed location with high accuracy compared to the case in which the coaxial cable is used. While the antenna device 110 according to the eleventh exemplary embodiment is basically similar to the antenna device 70 according to the seventh exemplary embodiment, it may be basically similar to the antenna device in another exemplary embodiment.

Twelfth Exemplary Embodiment

Figure 26:
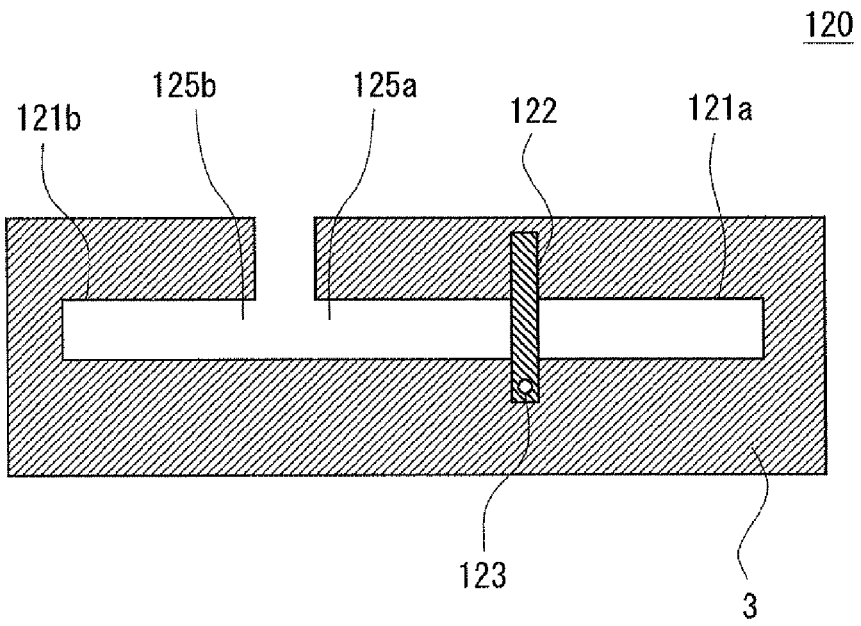
FIG. 26 is a plane view showing a schematic configuration of an antenna device according to a twelfth exemplary embodiment of the present invention.
Figure 27:
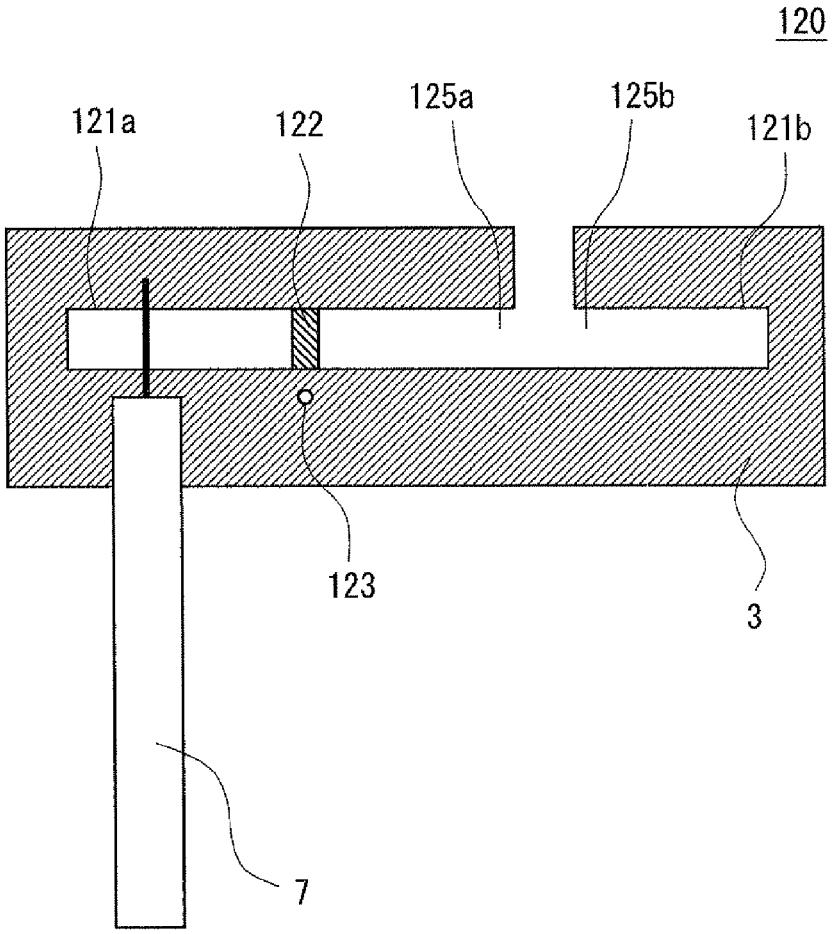
FIG. 27 is a plane view of the antenna device according to the twelfth exemplary embodiment of the present invention when seen from the rear side.

FIG. 26 is a plane view showing a schematic configuration of an antenna device 120 according to a twelfth exemplary embodiment of the present invention. FIG. 27 is a plane view of the antenna device 120 according to the twelfth exemplary embodiment when seen from the rear side. The antenna device 120 according to the twelfth exemplary embodiment is basically similar to the antenna device 90 according to the ninth exemplary embodiment. The sizes of the dielectric substrate 2 and the conductor plate 3 are reduced such that the conductor part of the conductor plate 3 remains around the two slots 121*a* and 121*b* so as to be used as antenna components.

Figure 28:
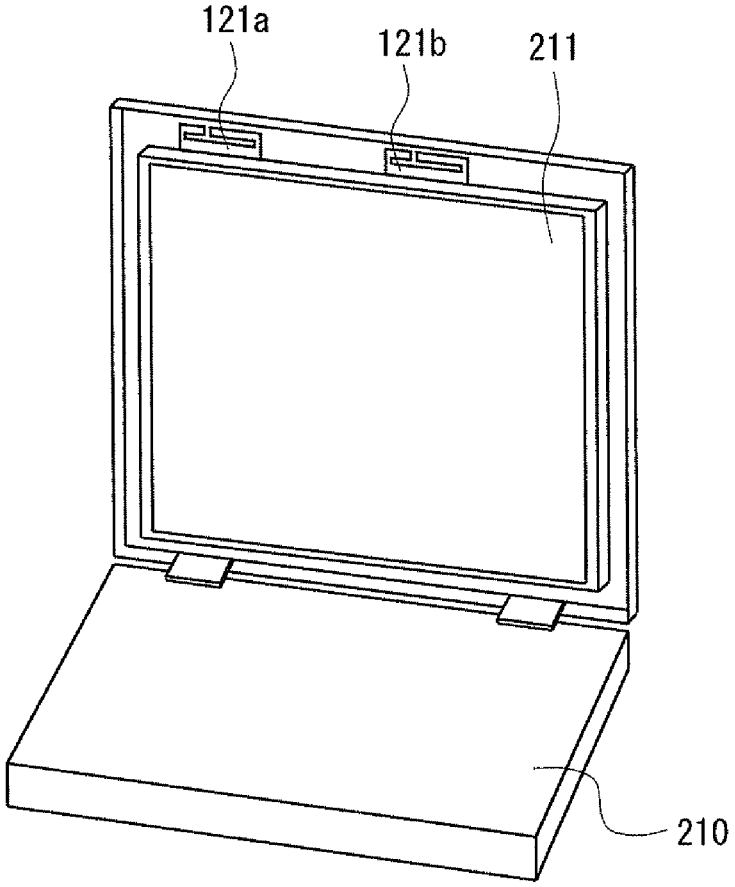
FIG. 28 is a diagram showing a state in which the antenna devices according to the twelfth exemplary embodiment of the present invention are mounted on a PC.

Consider, as an example, as shown in FIG. 28, a configuration in which antenna devices 120*a* and 120*b* are fixed to an upper part of an LCD 211 provided in a notebook PC (Personal Computer) 210. FIG. 28 shows a case in which two antennas are arranged with a predetermined interval assuming the MIMO so as to reduce the correlation coefficient between antennas. The antenna devices 120*a* and 120*b* can be connected to the radio circuit 8 of the notebook PC 210 by the coaxial cable 7 included in each of the antenna devices 120*a* and 120*b* to perform communication.

It is desirable that conductive tapes, screws or the like are used to fix the antenna devices 120*a* and 120*b* and the LCD 211 so that the conductor plate 3 and the metal part of the LCD 211 are electrically connected. Since the conductor plate 3 and the metal part of the LCD 211 are electrically connected, a current flows through the metal part of the LCD 211 and contributes to the radiation, thereby being able to improve the radiation efficiency. However, even when non-conductive tapes or another fixing method is used, it does not give any influence on the essential effects of the present invention. Another configuration may be employed in which the antennas are fixed to a part other than the LCD 211 (e.g., a case of the notebook PC 210).

In the twelfth exemplary embodiment, only one antenna may be arranged or three more antennas may be arranged, for example.

Described here is the form in which the antenna device 120 according to the twelfth exemplary embodiment is mounted on the notebook PC 210 as an example. However, the antenna device 120 may be mounted on another electronic device on which a radio circuit is mounted in a similar way. While the antenna device 120 according to the twelfth exemplary embodiment is basically similar to the antenna device 90 according to the ninth exemplary embodiment, it is not limited to this example and it may be basically similar to the antenna device in another exemplary embodiment.

The present invention is not limited to the above exemplary embodiments and may be changed as appropriate without departing from the spirit of the present invention.

Furthermore, a part or all of the above exemplary embodiments may be described as the following Supplementary notes. However, it is not limited to the following Supplementary notes.

(Supplementary Note 1)

An antenna device comprising: at least one dielectric substrate; a conductor plate arranged in the dielectric substrate; at least one slot formed in the conductor plate; at least one stub formed on a surface of the dielectric substrate different from a surface where the slot is formed, the stub being formed to cross the slot; and at least one via having one end connected to a periphery of the slot of the conductor plate and another end connected to the stub.

(Supplementary Note 2)

The antenna device according to (Supplementary note 1), wherein the stub is an open-end stub, and the length of the stub is shorter than 1/4 of a wavelength corresponding to a frequency to be used.

(Supplementary Note 3)

The antenna device according to (Supplementary note 1), wherein the stub is a short-end stub having a distal end short-circuited to the conductor plate, and the length of the stub is longer than 1/4 and shorter than 1/2 of a wavelength corresponding to a frequency to be used.

(Supplementary Note 4)

The antenna device according to any one of (Supplementary note 1) to (Supplementary note 3), wherein a plurality of stubs are arranged so as to cross the slot.

(Supplementary Note 5)

The antenna device according to any one of (Supplementary note 1) to (Supplementary note 4), wherein the slot has one end which is open-ended at an end surface of the conductor plate and another end which is short-circuited.

(Supplementary Note 6)

The antenna device according to any one of (Supplementary note 1) to (Supplementary note 5), wherein the stub is arranged at a periphery of the open end of the slot.

(Supplementary Note 7)

The antenna device according to any one of (Supplementary note 1) to (Supplementary note 6), wherein the stub is arranged at least at a location spaced apart from the open end of the slot by about 2/3, 2/5, or 4/5 of the slot length.

(Supplementary Note 8)

The antenna device according to any one of (Supplementary note 1) to (Supplementary note 7), wherein the conductor plate includes a first slot to which power is supplied and a second slot to which power is not supplied, each of the first slot and the second slot having one end which is open-ended and another end which is short-circuited, and the open end of the first slot and the open end of the second slot are opposed to each other.

(Supplementary Note 9)

The antenna device according to (Supplementary note 8), wherein the stub is arranged in another surface of the dielectric substrate to cross the second slot.

(Supplementary Note 10)

The antenna device according to any one of (Supplementary note 1) to (Supplementary note 4), wherein both ends of the slot are short-circuited.

(Supplementary Note 11)

The antenna device according to (Supplementary note 10), wherein the stub is arranged at the center of the slot.

(Supplementary Note 12)

The antenna device according to (Supplementary note 10), wherein the stub is arranged at a location spaced apart from the short-circuit end of the slot by about 1/4 of the slot length.

(Supplementary Note 13)

The antenna device according to any one of (Supplementary note 1) to (Supplementary note 12), wherein the slot is substantially L-shaped.

(Supplementary Note 14)

The antenna device according to (Supplementary note 13), wherein a corner part of the substantially L-shaped slot is obliquely bent.

(Supplementary Note 15)

The antenna device according to any one of (Supplementary note 1) to (Supplementary note 12), wherein the slot is substantially linearly formed.

(Supplementary Note 16)

The antenna device according to any one of (Supplementary note 1) to (Supplementary note 15), comprising a first slot antenna including a first slot formed in the conductor plate, a first stub formed to cross the first slot, and a first via connected to the first stub, and a second slot antenna including a second slot formed in the conductor plate, a second stub formed to cross the second slot, and a second via connected to the second stub.

(Supplementary Note 17)

The antenna device according to (Supplementary note 16), wherein the first slot antenna and the second slot antenna are orthogonal to each other.

(Supplementary Note 18)

The antenna device according to any one of (Supplementary note 1) to (Supplementary note 17), wherein a plurality of opening holes are formed in the dielectric substrate along the L-shaped slot.

(Supplementary Note 19)

The antenna device according to any one of (Supplementary note 1) to (Supplementary note 18), further comprising a feed cable having a first conductor and a second conductor connected to the conductor plate in respective sides of the slot so as to cross the slot, and a radio circuit that feeds the slot through the feed cable.

(Supplementary Note 20)

The antenna device according to any one of (Supplementary note 1) to (Supplementary note 18), further comprising a micro-strip line provided on another surface of the dielectric substrate to cross the slot, a feeding via having one end connected to a periphery of the slot of the conductor plate and another end connected to the stub, and a radio circuit that feeds the slot through the micro-strip line and the feeding via.

REFERENCE SIGNS LIST

2 DIELECTRIC SUBSTRATE
3 CONDUCTOR PLATE
4 SLOT
4*a* OPEN END
5 STUB
6 VIA
10, 20, 30, 40, 50, 60, 70, 80, 90, 100, 110 ANTENNA DEVICES

What is claimed is:

1. An antenna device comprising:

at least one dielectric substrate;

a conductor plate arranged in the dielectric substrate;

at least one slot formed in the conductor plate;

at least one stub formed on a surface of the dielectric substrate different from a surface in which the slot is formed, the stub being formed to cross the slot; and at least one via comprising one end connected to a periphery of the slot of the conductor plate and another end connected to one end of the stub, wherein a second end, opposite the first end, of the stub is one of an open-end with respect to the conductor plate and a short-end short-circuited to the conductor plate.

2. The antenna device according to claim 1, wherein:

the stub comprises the open-end stub, and a length of the stub is shorter than 1/4 of a wavelength corresponding to a frequency for which the antenna device is configured.

3. The antenna device according to claim 1, wherein:

the stub comprises the short-end stub comprising a distal end short-circuited to the conductor plate, and a length of the stub is longer than 1/4 and shorter than 1/2 of a wavelength corresponding to a frequency for which the antenna device is configured.

4. The antenna device according to claim 1, wherein a plurality of stubs are arranged so as to cross the slot.

5. The antenna device according to claim 1, wherein the slot comprises one end which is open-ended at an end surface of the conductor plate and another end which is short-circuited.

6. The antenna device according to claim 1, wherein the stub is arranged at a periphery of an open end of the slot.

7. The antenna device according to claim 1, wherein the stub is arranged at least at a location spaced apart from an open end of the slot by about 2/3, 2/5, or 4/5 of a slot length of the slot.

8. The antenna device according to claim 1, wherein:

the conductor plate comprises a first slot to which power is supplied and a second slot to which power is not supplied, each of the first slot and the second slot comprises one end which is open-ended and another end which is short-circuited, and the open end of the first slot and the open end of the second slot are opposed to each other.

9. The antenna device according to claim 8, wherein the stub is arranged in another surface of the dielectric substrate to cross the second slot.

10. The antenna device according to claim 1, wherein both ends of the slot are short-circuited.

* * * * *